US010689950B2

(12) United States Patent
Johnson et al.

(10) Patent No.: US 10,689,950 B2
(45) Date of Patent: Jun. 23, 2020

(54) APPARATUS, SYSTEMS AND METHODS FOR CONTROLLING FLOW COMMUNICATION WITH A SUBTERRANEAN FORMATION

(71) Applicant: NCS MULTISTAGE INC., Calgary (CA)

(72) Inventors: Tim Johnson, Calgary (CA); John Ravensbergen, Calgary (CA)

(73) Assignee: NCS Multistage Inc., Calgary (CA)

( * ) Notice: Subject to any disclaimer, the term of this patent is extended or adjusted under 35 U.S.C. 154(b) by 187 days.

(21) Appl. No.: 15/494,617

(22) Filed: Apr. 24, 2017

(65) Prior Publication Data

US 2017/0306722 A1 Oct. 26, 2017

Related U.S. Application Data

(60) Provisional application No. 62/326,306, filed on Apr. 22, 2016.

(51) Int. Cl.

| | |
|---|---|
| ***E21B 31/14*** | (2006.01) |
| ***E21B 34/14*** | (2006.01) |
| ***E21B 47/09*** | (2012.01) |
| *E21B 34/00* | (2006.01) |
| *E21B 43/26* | (2006.01) |

(52) U.S. Cl.

CPC ..... *E21B 34/14* (2013.01); *E21B 47/09* (2013.01); *E21B 43/26* (2013.01); *E21B 2034/007* (2013.01)

(58) Field of Classification Search

CPC .. E21B 43/04; E21B 43/08–088; E21B 43/26; E21B 33/12; E21B 34/06; E21B 34/14; E21B 2034/007

See application file for complete search history.

(56) References Cited

U.S. PATENT DOCUMENTS

| | | | |
|---|---|---|---|
| 3,080,924 | A | 3/1963 | Baker |
| 3,115,188 | A | 12/1963 | Cochran et al. |
| 3,130,788 | A | 4/1964 | Cochran et al. |
| 3,457,994 | A | 7/1969 | Stachowiak |
| 3,638,723 | A | 2/1972 | Carroll |
| 4,284,154 | A | 8/1981 | England |
| 4,671,354 | A | 6/1987 | Henderson et al. |
| 4,702,313 | A | 10/1987 | Greenlee et al. |
| 4,749,044 | A | 6/1988 | Skipper et al. |
| 4,862,961 | A | 9/1989 | Neff |
| 4,949,788 | A | 8/1990 | Szarka et al. |
| 4,971,146 | A | 11/1990 | Terrell |
| 5,156,207 | A | 10/1992 | Haugen et al. |
| 5,263,683 | A | 11/1993 | Wong |

(Continued)

FOREIGN PATENT DOCUMENTS

| | | |
|---|---|---|
| CA | 2859813 | 2/2016 |
| CA | 2958702 | 2/2016 |

(Continued)

*Primary Examiner* — David Carroll

(74) *Attorney, Agent, or Firm* — Ridout and Maybee LLP

(57) ABSTRACT

In one aspect, there is provided a flow control apparatus comprising a confirmation profile that is establishable, in response to completion of a wellbore operation that has changed a condition of the flow control apparatus, for releasably retaining an indicator tool that is being displaced within the wellbore via a workstring.

23 Claims, 8 Drawing Sheets

(56) References Cited

U.S. PATENT DOCUMENTS

| | | | | |
|---|---|---|---|---|
| 5,366,019 | A | 11/1994 | Brooks | |
| 5,513,703 | A | 5/1996 | Mills et al. | |
| 5,687,795 | A | 11/1997 | Patel et al. | |
| 5,829,531 | A | 11/1998 | Hebert et al. | |
| 6,827,148 | B2 | 12/2004 | Shaw et al. | |
| 7,284,606 | B2 | 10/2007 | Coronado | |
| 7,284,608 | B2 | 10/2007 | Reddy et al. | |
| 7,387,165 | B2 | 6/2008 | Lopez de Cardenas et al. | |
| 7,748,463 | B2 | 7/2010 | Revheim | |
| 7,793,716 | B2 | 9/2010 | Macias et al. | |
| 7,870,907 | B2 | 1/2011 | Lembcke et al. | |
| 7,971,646 | B2 | 7/2011 | Murray et al. | |
| 8,074,713 | B2 | 12/2011 | Ramos et al. | |
| 8,127,847 | B2 | 3/2012 | Richard et al. | |
| 8,171,994 | B2 | 5/2012 | Murray et al. | |
| 8,225,869 | B2 | 7/2012 | Beard et al. | |
| 8,267,172 | B2 | 9/2012 | Surjaatmadja et al. | |
| 8,291,982 | B2 | 10/2012 | Murray et al. | |
| 8,312,925 | B2 | 11/2012 | Trummer | |
| 8,490,702 | B2 | 7/2013 | Stromquist et al. | |
| 8,567,501 | B2 | 10/2013 | Zimmerman et al. | |
| 8,607,860 | B2 * | 12/2013 | Avant | E21B 23/02 166/117.6 |
| 8,794,331 | B2 | 8/2014 | Getzlaf et al. | |
| 9,217,316 | B2 | 12/2015 | Ehtesham et al. | |
| 9,982,512 | B2 | 5/2018 | Getzlaf et al. | |
| 10,030,479 | B2 | 7/2018 | Johnson et al. | |
| 10,151,162 | B2 | 12/2018 | Getzlaf et al. | |
| 10,161,207 | B2 | 12/2018 | Ravensbergen et al. | |
| 2002/0070028 | A1 | 6/2002 | Garcia et al. | |
| 2003/0019634 | A1 | 1/2003 | Henderson et al. | |
| 2004/0149452 | A1 | 8/2004 | Pendleton | |
| 2006/0081380 | A1 | 4/2006 | Hoffman et al. | |
| 2006/0225878 | A1 | 10/2006 | Coronado | |
| 2008/0257558 | A1 | 10/2008 | Darnell et al. | |
| 2008/0154184 | A1 | 12/2008 | Johnson et al. | |
| 2009/0044944 | A1 | 2/2009 | Murray et al. | |
| 2009/0078413 | A1 | 3/2009 | Tubel et al. | |
| 2011/0042107 | A1 | 2/2011 | Chambers et al. | |
| 2011/0048706 | A1 | 3/2011 | Clem et al. | |
| 2011/0174491 | A1 | 7/2011 | Ravensbergen et al. | |
| 2011/0203809 | A1 | 8/2011 | Knobloch et al. | |
| 2012/0067583 | A1 | 3/2012 | Zimmerman et al. | |
| 2012/0090847 | A1 * | 4/2012 | Getzlaf | E21B 23/02 166/305.1 |
| 2012/0097398 | A1 | 4/2012 | Ravensbergen et al. | |
| 2012/0279709 | A1 | 11/2012 | Bain et al. | |
| 2012/3025500 | | 12/2012 | Moen | |
| 2013/0080188 | A1 | 3/2013 | Rosenfeld | |
| 2013/0133891 | A1 | 5/2013 | Getzlaf et al. | |
| 2013/0161027 | A1 | 6/2013 | Inglis et al. | |
| 2013/0168099 | A1 | 7/2013 | Themig | |
| 2013/0319687 | A1 | 12/2013 | Huh et al. | |
| 2013/0333883 | A1 * | 12/2013 | Ehtesham | E21B 43/00 166/255.1 |
| 2014/0014347 | A1 | 1/2014 | Adam et al. | |
| 2014/0014360 | A1 | 1/2014 | Wilson | |
| 2014/0048271 | A1 | 2/2014 | Coon | |
| 2015/0075788 | A1 * | 3/2015 | O'Brien | E21B 23/00 166/255.2 |
| 2015/0075815 | A1 * | 3/2015 | O'Brien | E21B 23/006 166/382 |
| 2015/0152725 | A1 | 6/2015 | Thomas et al. | |
| 2016/0047189 | A1 | 2/2016 | Macleod et al. | |
| 2016/0090803 | A1 | 3/2016 | Getzlaf et al. | |
| 2017/0183929 | A1 * | 6/2017 | Werries | E21B 23/03 |
| 2018/0245430 | A1 | 8/2018 | Getzlaf et al. | |
| 2019/0003285 | A1 | 1/2019 | Johnson et al. | |

FOREIGN PATENT DOCUMENTS

| | | | |
|---|---|---|---|
| CA | 3034357 | | 2/2016 |
| CA | 2906468 | | 3/2016 |
| CA | 2916199 | | 6/2016 |
| CA | 2916422 | | 6/2016 |
| CA | 2960690 | | 5/2017 |
| CA | 2965068 | | 10/2017 |
| CA | 2916168 | | 4/2019 |
| EP | 0810348 | A2 | 12/1997 |
| EP | 2295715 | | 3/2011 |
| EP | 3237724 | | 11/2017 |
| EP | 3374592 | | 9/2018 |
| GB | 2439399 | A | 12/2007 |
| WO | WO200102697 | A1 | 1/2001 |
| WO | WO2007084006 | A1 | 7/2007 |
| WO | WO2012149637 | A1 | 11/2012 |
| WO | WO2012149638 | | 11/2012 |
| WO | WO2016026024 | | 2/2016 |
| WO | WO2016101061 | A1 | 6/2016 |
| WO | WO2017079823 | A1 | 5/2017 |

* cited by examiner

SECTION A-A

DETAIL D

DETAIL C

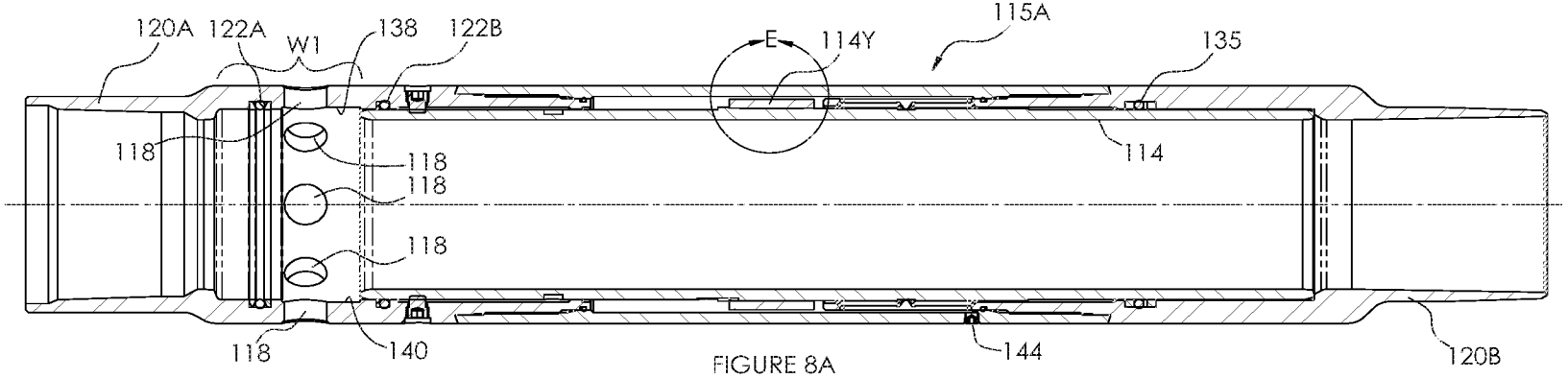
FIGURE 8A
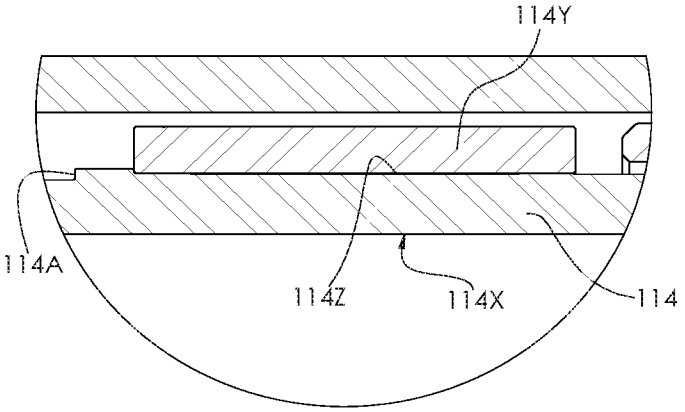
DETAIL E FIGURE 8B

APPARATUS, SYSTEMS AND METHODS FOR CONTROLLING FLOW COMMUNICATION WITH A SUBTERRANEAN FORMATION

FIELD

The present disclosure relates to controlling flow communication with a subterranean formation using a flow control member.

BACKGROUND

Because wellbore operations, such as opening and closing of downhole valve, are conducted downhole, it is difficult to determine, with certainty, whether the wellbore operation has been successfully completed. As well, ingress of solid debris can interfere with the manipulation of such downhole valves.

SUMMARY

In one aspect, there is provided a flow control apparatus comprising a confirmation profile that is establishable, in response to completion of a wellbore operation that has changed a condition of the flow control apparatus, for releasably retaining an indicator tool that is being displaced within the wellbore via a workstring.

In another aspect, there is provided a system comprising an indicator tool that is deployable into a wellbore via a workstring and a flow control apparatus including a confirmation profile that is establishable, in response to completion of a wellbore operation that has changed a condition of the flow control apparatus, for releasably retaining the indicator tool that is being displaced relative to the wellbore via the workstring.

In another aspect, there is provided a downhole process comprising: within a wellbore, performing a downhole wellbore operation with effect that a confirmation profile is established upon completion of the downhole wellbore operation, and confirming the completion of the downhole wellbore operation by locating an indicator tool within the confirmation profile and detecting the locating.

In another aspect, there is provided a flow control apparatus, comprising: a housing including one or more ports and a stop; a housing passage extending through the housing; a flow control member, displaceable relative to the one or more ports, for controlling flow communication between the housing passage and the one or more ports; and including an engager for engaging the stop; and a housing space; wherein: the stop is disposed within the housing space; the one or more ports, the stop, and the engager are co-operatively configured such that, while the engager is engaged to the stop, closing of the one or more ports is being effected by the flow control member; and the housing and the flow control member are co-operatively configured such that ingress of material, from the housing passage and into the housing space, is prevented or substantially prevented.

In another aspect, there is provided a flow control apparatus, comprising: a housing including one or more ports and a stop; a housing passage extending through the housing; a flow control member, displaceable relative to the one or more ports, for controlling flow communication between the housing passage and the one or more ports; and including an engager for engaging the stop; and a housing space extending between a first sealing member and a second sealing member; wherein: the stop is disposed within the housing space; and the one or more ports, the stop, and the engager are co-operatively configured such that, while the engager is engaged to the stop, closing of the one or more ports is effected by the flow control member.

In another aspect, there is provided a flow control apparatus, comprising; a housing including one or more ports and a stop; a housing passage extending through the housing; a flow control member, displaceable relative to the one or more ports, for controlling flow communication between the housing passage and the one or more ports; and including an engager for engaging the stop; and a housing space; wherein: the stop is disposed within the housing space; the one or more ports, the stop, and the engager are co-operatively configured such that, while the engager is engaged to the stop, closing of the one or more ports is being effected by the flow control member; the housing and the flow control member are co-operatively configured such that ingress of material, from the housing passage and into the housing space, is prevented or substantially prevented; the housing space includes a first subspace and a second subspace; a housing space passage is defined between the stop and the flow control member for effecting flow communication between the first and second subspaces; and the total volume of the first subspace is at least five (5)% of the total volume of the housing space.

In yet a further aspect, there is provided a flow control apparatus, comprising: a housing including one or more ports and a stop; a housing passage extending through the housing; a flow control member, displaceable relative to the one or more ports, for controlling flow communication between the housing passage and the one or more ports; and including an engager for engaging the stop; and a housing space extending between a first sealing member and a second sealing member; wherein: the stop is disposed within the housing space; the one or more ports, the stop, and the engager are co-operatively configured such that, while the engager is engaged to the stop, closing of the one or more ports is being effected by the flow control member; the housing space includes a first subspace and a second subspace; a housing space passage is defined between the stop and the flow control member for effecting flow communication between the first and second subspaces; and the total volume of the first subspace is at least five (5)% of the total volume of the housing space.

BRIEF DESCRIPTION OF DRAWINGS

The preferred embodiments will now be described with the following accompanying drawings, in which:

FIG. 8A is a side sectional view of a flow control apparatus illustrated in FIG. 7, illustrating the ports in the open condition;

FIG. 8B is a detailed view of Detail "E" in FIG. 8A; and

DETAILED DESCRIPTION

Figure 1:
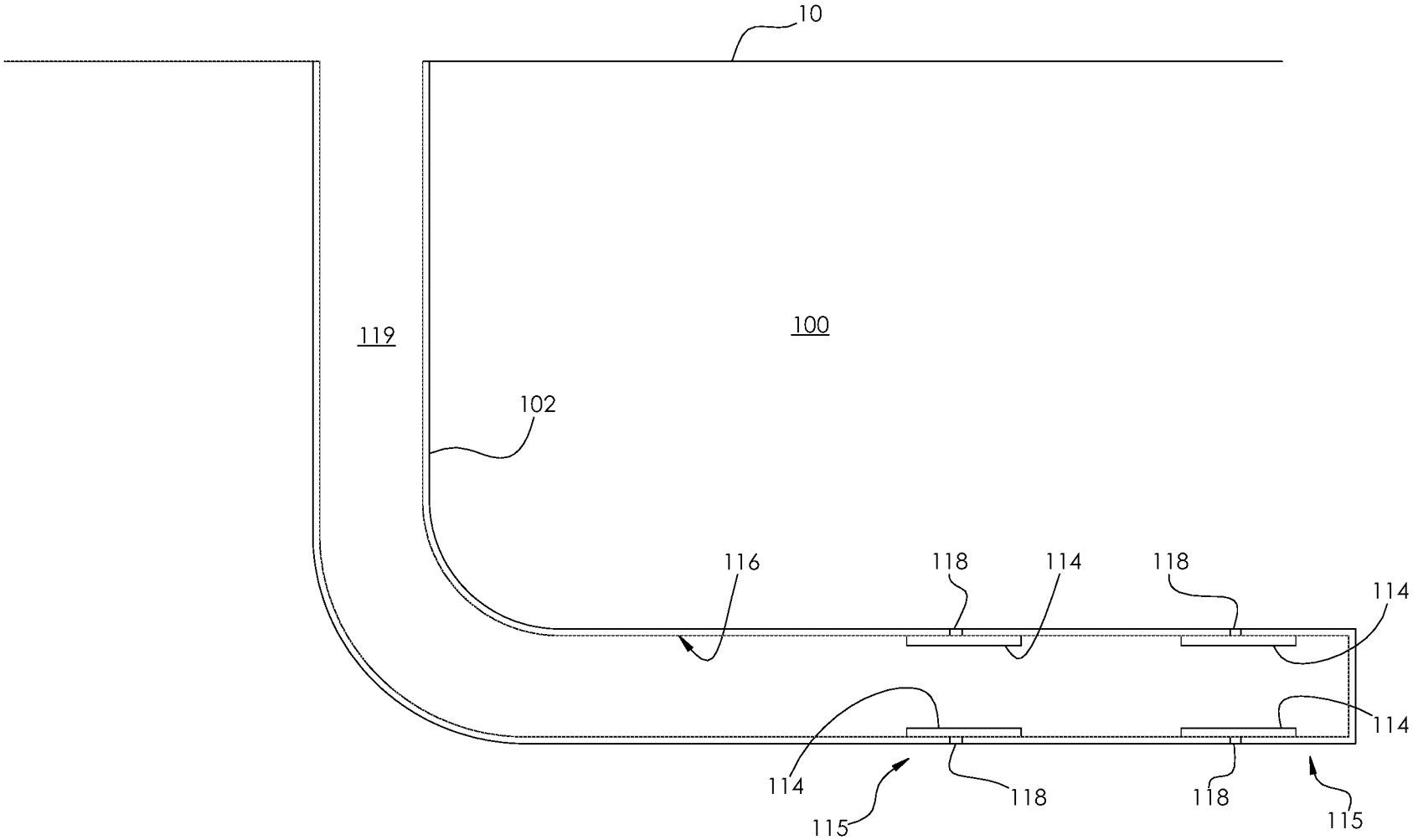
FIG. 1 is a schematic illustration of a system for effecting fluid communication between the surface and a subterranean formation via a wellbore.

Referring to FIG. 1, there is provided a wellbore material transfer system 104 for conducting material to a subterranean formation 100 via a wellbore 102, from a subterranean formation 100 via a wellbore 102, or both to and from a subterranean formation 100 via a wellbore 102. In some embodiments, for example, the subterranean formation 100 is a hydrocarbon material-containing reservoir.

In some embodiments, for example, the conducting (such as, for example, by flowing) material to a subterranean formation 100 via a wellbore 102 is for effecting selective stimulation of a hydrocarbon material-containing reservoir. The stimulation is effected by supplying treatment material to the hydrocarbon material-containing reservoir. In some embodiments, for example, the treatment material is a liquid including water. In some embodiments, for example, the liquid includes water and chemical additives. In other embodiments, for example, the treatment material is a slurry including water, proppant, and chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir. In some embodiments, for example, the treatment material includes water, and is supplied to effect waterflooding of the reservoir.

In some embodiments, for example, the conducting (such as, for example, by flowing) material from a subterranean formation 100 via a wellbore 102 is for effecting production of hydrocarbon material from the hydrocarbon material-containing reservoir. In some of these embodiments, for example, the hydrocarbon material-containing reservoir, whose hydrocarbon material is being produced by the conducting via the wellbore 102, has been, prior to the producing, stimulated by the supplying of treatment material to the hydrocarbon material-containing reservoir.

In some embodiments, for example, the conducting to the subterranean formation 100 from the wellbore 102, or from the subterranean formation 100 to the wellbore 102, is effected via one or more flow communication stations that are disposed at the interface between the subterranean formation 100 and the wellbore 102. In some embodiments, for example, the flow communication stations are integrated within a wellbore string 116 that is deployed within the wellbore 102. Integration may be effected, for example, by way of threading or welding.

The wellbore string 116 includes one or more of pipe, casing, and liner, and may also include various forms of tubular segments, such as the flow communication stations 115 described herein. The wellbore string 116 defines a wellbore string passage 119. In some embodiments, for example, the flow communication stations 115 are integratable within the wellbore string 116 by a threaded connection.

Successive flow communication stations 115 may be spaced from each other along the wellbore string 116 such that each one of the flow communication stations 115, independently, is positioned adjacent a zone or interval of the subterranean formation 100 for effecting flow communication between the wellbore 102 and the zone (or interval).

Figure 2:
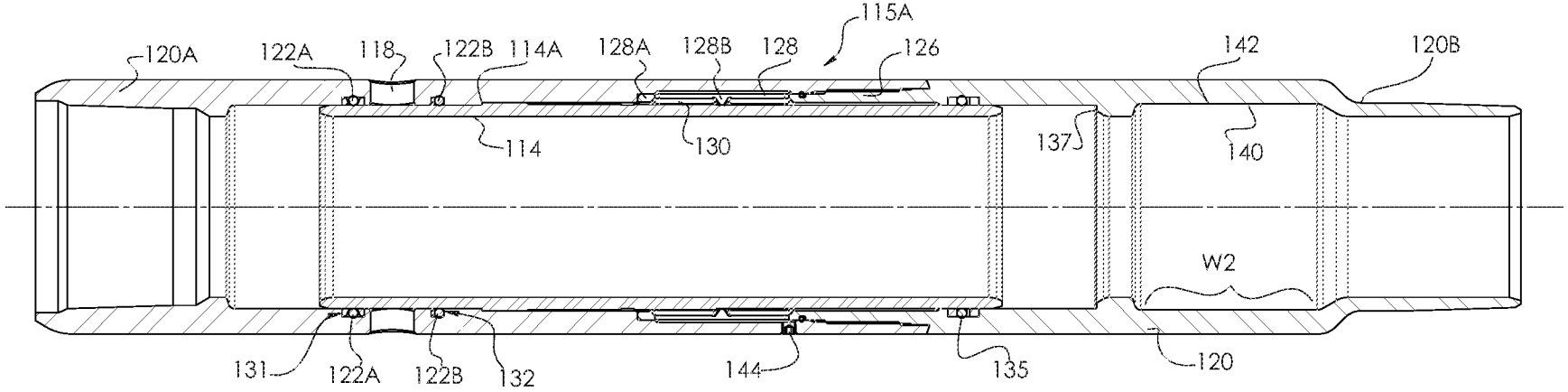
FIG. 2 is a side sectional view of an embodiment of a flow control apparatus for use in the system illustrated in FIG. 1, illustrating the ports in the closed condition.
Figure 3:
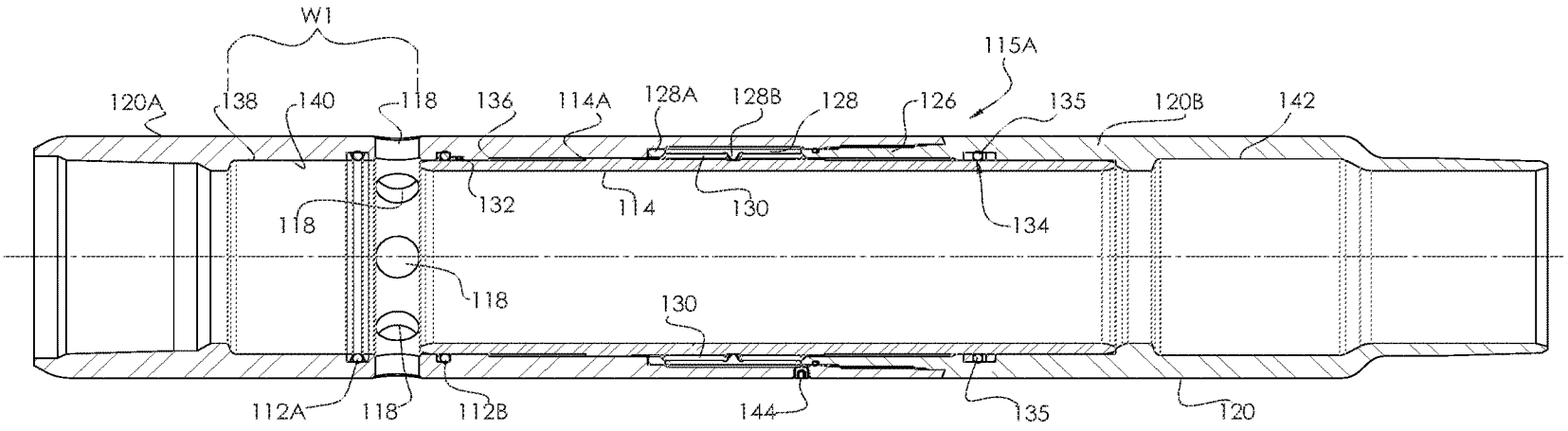
FIG. 3 is a side sectional view of a flow control apparatus illustrated in FIG. 2, illustrating the ports in the open condition.
Figure 4:
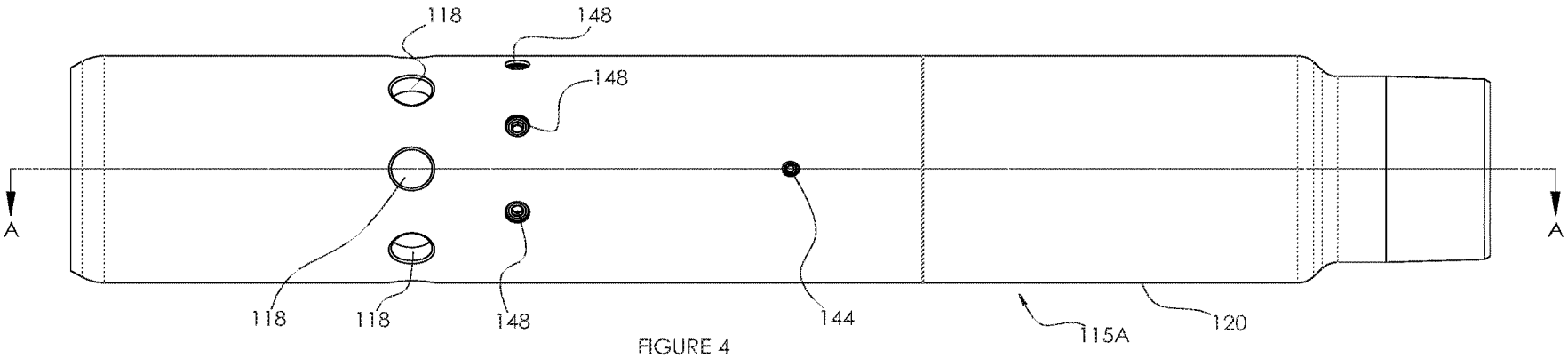
FIG. 4 is a side view of the flow control apparatus illustrated in FIGS. 2 and 3.

For effecting the flow communication, the flow communication station 115 includes a flow control apparatus 115A. Referring to FIGS. 2 to 4, the flow control apparatus 115A includes one or more ports 118 through which the conducting of the material is effected. The ports 118 are disposed within a sub that has been integrated within the wellbore string 116, and are pre-existing, in that the ports 118 exist before the sub, along with the wellbore string 116, has been installed downhole within the wellbore string 116.

The flow control apparatus 115A includes a flow control member 114 for controlling the conducting of material by the flow control apparatus 115A via the one or more ports 118. The flow control member 114 is displaceable, relative to the one or more ports 118, for effecting opening of the one or more ports 118. In some embodiments, for example, the flow control member 114 is also displaceable, relative to the one or more ports 118, for effecting closing of the one or more ports 118. In this respect, the flow control member 114 is displaceable such that the flow control member 114 is positionable between open and closed positions. The open position of the flow control member 114 corresponds to an open condition of the one or more ports 118. The closed position of the flow control member 114 corresponds to a closed condition of the one or more ports 118.

In some embodiments, for example, the flow control member 114 is displaceble mechanically, such as, for example, with a shifting tool 204. Suitable shifting tools 202 include those described in U.S. Patent Publication No. 2016/0251929A1. In some embodiments, for example, the flow control member 114 is displaceable hydraulically, such as, for example, by communicating pressurized fluid via the wellbore to urge the displacement of the flow control member 14. In some embodiments, for example, the flow control member 114 is integrated within a flow control apparatus which includes a trigger for effecting displacement of the flow control member 114 hydraulically in response to receiving of a signal transmitted from the surface 10.

In some embodiments, for example, in the closed position, the one or more ports 118 are covered by the flow control member 114, and the displacement of the flow control member 114 to the open position effects at least a partial uncovering of the one or more ports 118 such that the 118 becomes disposed in the open condition. In some embodiments, for example, in the closed position, the flow control member 114 is disposed, relative to the one or more ports 118, such that first and second sealed interfaces 131, 132 are disposed between the wellbore string 116 and the subterranean formation 100, and the disposition of the sealed interfaces 131, 132 is such that the conduction of material between the wellbore string 116 and the subterranean formation 100, via the flow communication station 115 is prevented, or substantially prevented, and displacement of the flow control member 114 to the open position effects flow communication, via the one or more ports 118, between the wellbore string 116 and the subterranean formation 100, such that the conducting of material between the wellbore string 116 and the subterranean formation 100, via the flow communication station, is enabled. In some embodiments, for example, the sealed interfaces 131, 132 are established by sealing engagement between the flow control member 114 and the wellbore string 116. In some embodiments, for example, the flow control member 114 includes a sleeve. The sleeve is slideably disposed within the wellbore string passage 119.

In some embodiments, for example, the flow control apparatus 115A includes a housing 120. In some embodiments, for example, the housing 120 includes an upper sub 120A and a lower sub 120B. The housing 120 includes one or more sealing surfaces 122A, 122B configured for sealing engagement with a flow control member 114. In some embodiments, for example, the sealing engagement defines the sealed interfaces 131, 132 described above. In this respect, sealing surfaces 122A, 122B are defined on an internal surface of the housing 120 for sealing engagement with the flow control member 114. In some embodiments, for example, each one of the sealing surfaces 122A, 122B is defined by a respective sealing member. In some embodiments, for example, each one of the sealing members, independently, includes an o-ring. In some embodiments, for example, the o-ring is housed within a recess formed within the upper sub 120A. In some embodiments, for example, the sealing member includes a molded sealing member (i.e. a sealing member that is fitted within, and/or bonded to, a groove formed within the sub that receives the sealing member). In some embodiments, for example, the port 118 extends through the housing 120, and is disposed between the sealing surfaces 122A, 122B.

The flow control member 114 co-operates with the sealing members 122A, 122B to effect opening and closing of the port 118. When the port 118 is disposed in the closed condition, the flow control member 114 is sealingly engaged to both of the sealing members 122A, 122B, thereby preventing, or substantially preventing, treatment material, being supplied through the wellbore string passage 119 from being injected into the subterranean formation 100 via the port 118. While the port 118 is disposed in the open condition, the flow control member 114 is spaced apart or retracted from at least one of the sealing members thereby providing a passage for treatment material, being supplied through the wellbore string passage 119, to be injected into the subterranean formation 100 via the port 118.

A resilient retainer member 126 extends from the housing 120 (and, in the illustrated embodiments, specifically, the lower sub 120B), and is configured to releasably retain the flow control member 114 and thereby resist a displacement of the flow control member 114. In some embodiments, for example, the resisting is a resisting of displacement of the flow control member 114 from the closed position to the open position. In some embodiments, for example, the resisting is a resisting of displacement of the flow control member 114 from the open position to the closed position. In some embodiments, for example, the resisting is a resisting of displacement of the flow control member 114 between the closed position and the open position.

In the illustrated embodiment, the resisting includes a resisting of displacement of the flow control member 114 between the closed position and the open position. In this respect, in some of these embodiments, for example, the resilient retainer member 126 includes at least one finger 128, and each one of the at least one finger includes a pairs of tabs 128A, 128B. The tab 128A is configured to releasably retain the flow control member 114 in the closed position. The tab 128B is configured to releasably retain the flow control member 114 in the open position. The flow control member 114 includes a recess configured to receive each one of the tabs 128A, 128B, independently, for effecting the releasable retention.

In some embodiments, for example, the resilient retainer member 126 is in the form of a collet.

The flow control member 114 and the resilient retainer member 126 are co-operatively configured such that releasable retention of the flow control member 114 by the resilient retainer member 126 is effected while the flow control member 114 is disposed in the open position and also while the flow control member 114 is disposed in the closed position. In this respect, while the flow control member 114 is disposed in the closed position, the resilient retainer member 126 is releasably retaining the flow control member 114 such that resistance is being effected to displacement of the flow control member 114 from the closed position to the open position. Also in this respect, while the flow control member 114 is disposed in the open position, the resilient retainer member 126 is releasably retaining the flow control member 114 such that resistance is being effected to displacement of the flow control member 114 from the open position to the closed position.

In some embodiments, for example, the releasable retention of the flow control member 114 by the resilient retainer member 126 is such that the resilient retainer member 126 is displaceable relative to the flow control member 114, in response to application of the opening force to the flow control member 114, such that the flow control member 114 becomes released from the releasable retention by the resilient retainer member 126 and becomes displaceable relative to the port 118. In some embodiments, for example, such displacement includes deflection of the resilient retainer member 126. In some embodiments, for example, when the flow control member 114 is disposed in the closed position, the deflection includes a deflection of the finger tab 128A from the recess of the flow control member 114, and when the flow control member 114 is disposed in the open position, the deflection includes a deflection of the finger tab 128B from the recess of the flow control member 114.

In some embodiments, for example in order to effect the displacement of the flow control member 114 from the closed position to the open position, the opening force is sufficient to effect displacement of the tab 128A from (or out of) the recess of the flow control member 114. In this respect, the tab 128A is sufficiently resilient such that application of the opening force effects the displacement of the tab 128A from the recess, such as by the deflection of the tab 128A. Once the finger tab 128A has become displaced out of the recess, continued application of force to the flow control member 114 (such as, in the illustrated embodiment, in a downhole direction) effects displacement of the flow control member 114 from the closed position to the open position. In order to effect the displacement of the flow control member 114 from the open position to the closed position, the closing force is sufficient to effect displacement of the tab 128B from (or out of) the recess of the flow control member 114, such as by deflection of the tab 128B. In this respect, the tab 128B is sufficiently resilient such that application of the closing force effects the displacement of the tab 128B from the recess. Once the tab 128B has become displaced out of the recess, continued application of force to the flow control member 114 (such as, in the illustrated embodiment, in an uphole direction) effects displacement of the flow control member 114 from the open position to the closed position.

Each one of the opening force and the closing force may be, independently, applied to the flow control member 114 mechanically, hydraulically, or a combination thereof. In some embodiments, for example, the applied force is a mechanical force, and such force is applied by a shifting tool 204 of a workstring. In some embodiments, for example, the applied force is hydraulic, and is applied by a pressurized fluid.

In some embodiments, for example, while the flow control apparatus 115A is being deployed downhole with the wellbore string 116, the flow control member 114 is retained in the closed position, and is restricted from displacement relative to the port 118 such that opening of the port 118 is effected, by one or more frangible members 148 (such as, for example, shear pins). The one or more frangible members 148 are provided to retain the flow control member 114 relative to the wellbore string 116 (including while the wellbore string is being installed downhole) so that the passage 119 is maintained fluidically isolated from the formation 100 until it is desired to treat the formation 100 with treatment material. To effect the initial displacement of the flow control member 114 from the closed position to the open position, sufficient force must first be applied to the one or more shear pins such that the one or more frangible members 148 become sheared, resulting in the flow control member 114 becoming moveable relative to the port 118. In some operational implementations, the force that effects the shearing is applied by a workstring.

Internal stop shoulders 136, 137 are defined within the housing 112 to limit the displaceability of the flow control member 114. The stop shoulder 136 limits uphole displacement of the flow control member 114, and the stop shoulder 137 limits downhole displacement of the flow control member 114. In some embodiments, for example, both of the stop shoulders 136, 138 are disposed either: (i) downhole of the one or more ports 118 (as illustrated), or (ii) uphole of the one or more ports 118, for reducing space requirements. The flow control member 114 includes an engagement shoulder 114A for engaging the stop shoulder 136 to thereby limit uphole displacement of the flow control member 114. The engagement of the engagement shoulder 114A to the stop shoulder 136 establishes the closed position of the flow control member 114. In this respect, the stop shoulder 136, the flow control member 114, and the one or more ports 118 are co-operatively configured such that while the flow control member 114 is engaged to the stop shoulder 136, the flow control member 114 is disposed in the closed position relative to the one or more ports 118.

The flow control member 114 is co-operatively configured with the housing 120 to define a housing space 130 between the housing 120 and the flow control member 114. In some of these embodiments, for example, the housing space 130 is disposed between the second sealed interface 132 and a third sealed interface 134, the sealed interfaces 132, 134 being defined between the flow control member 114 and the housing 120. The sealed interface 132 is defined by the sealing engagement of the sealing member 122B and the flow control member 114. The sealed interface 134 is defined by the sealing engagement between a third sealing member 135 and the flow control member 114, the third sealing member 135 being housed within the lower sub 120B. The sealed interfaces 132, 134 are maintained throughout the range of travel of the flow control member 114, including the displacement between the open and closed positions. In this respect, in some embodiments, for example, the second and third sealed interface 132, 134 are provided for preventing, or substantially preventing, ingress of material (such as, for example, solid debris, such as, for example, cement) into the housing space 130 from the passage 119. Such ingress of material could otherwise interfere with the displaceability of the flow control member 114, such as, for example, the displacement of the flow control member 114 from the open position to the closed position (for effecting closing of the one or more ports 118), by accumulating between the stop shoulder 136 and the engagement shoulder 114A of the flow control member 114.

Figure 9:
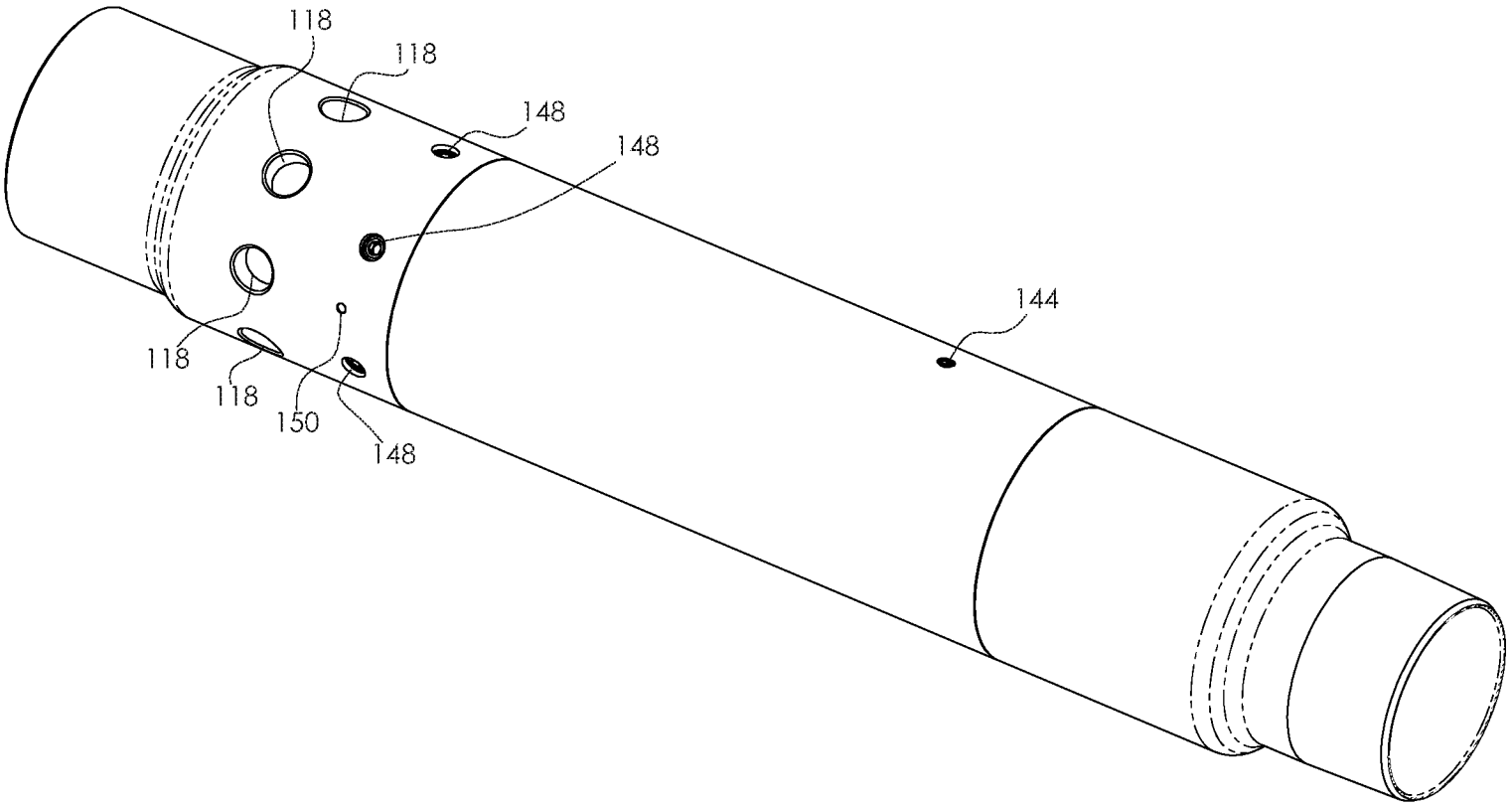
FIG. 9 is a perspective view of the flow control apparatus illustrated in FIG. 7.

In some embodiments, for example, viscous liquid material is disposed within the housing space 130. In some embodiments, for example, the housing space 130 is filled, or substantially filled, with the viscous liquid material. In some embodiments, for example, the viscous liquid material has a viscosity of at least 100 $mm^2/s$ at 40 degrees Celsius. In some embodiments, for example, the viscous liquid material includes an encapsulated cement retardant. In some embodiments, for example, the viscous liquid material includes grease. In some embodiments, for example, the viscous liquid material is supplied to the housing space 130 via a fill port 144. In some embodiments, for example, the housing 120 further includes a vent port 150 (see FIG. 9) for enabling discharge of gaseous material from the housing space in response to supplying of viscous liquid material to the housing space, thereby mitigating deflection of the flow control member 114 caused by gaseous material compressed by the viscous liquid material being supplied to the housing space 130, which could interfere with displaceability of the flow control member 114.

Figure 7A:
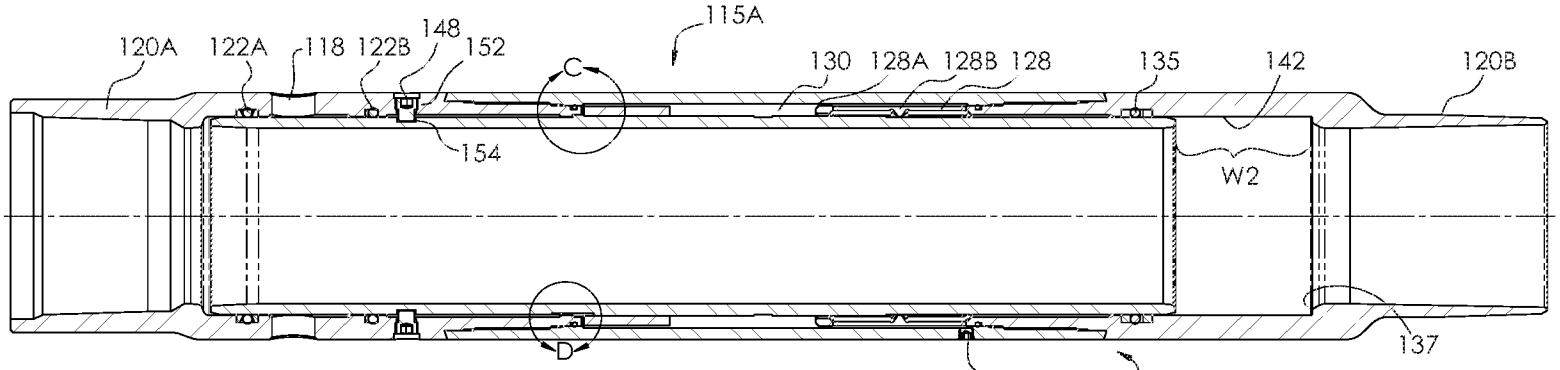
FIG. 7A is a side sectional view of another embodiment of a flow control apparatus for use in the system illustrated in FIG. 1, illustrating the ports in the closed condition.
Figure 7C:
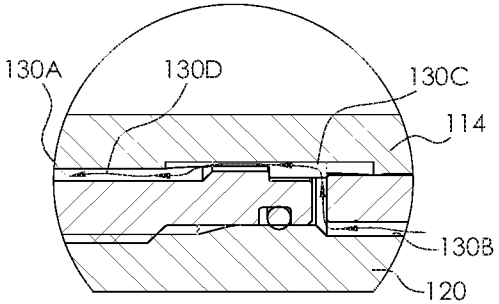
FIG. 7C is a detailed view of Detail "D" in FIG. 7A, and additionally illustrating the flow path taken by viscous liquid material being injected from an injection port.
Figure 7B:
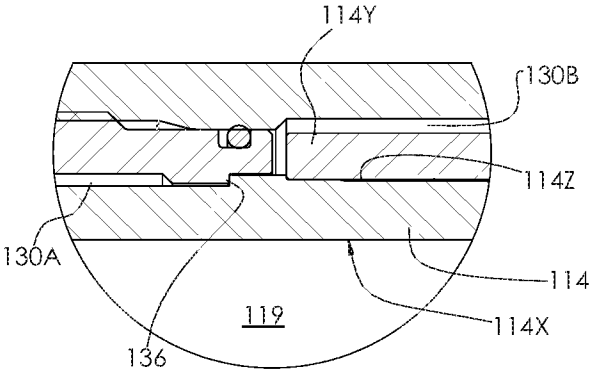
FIG. 7B is a detailed view of Detail "C' in FIG. 7A.

Referring to FIG. 7A, in some embodiments, for example, the one or more shear pins 148 extend through the housing 120 and the flow control member 114 via corresponding bores 152, 154, uphole of the stop shoulder 136. In this respect, a potential passage for ingress of material from the passage 119 to the housing space 130 via the bore 154, and it is desirable for viscous liquid material, being injected into the housing space 130, via an injection port 144 that extends into a portion of the housing space 130 that is downhole of the stop shoulder 136 (i.e. the downhole subspace 130B), become disposed in a portion of the housing space 130 that is uphole of the stop shoulder 136 and downhole of the sealing interface 132 (i.e. the uphole subspace 130A). The viscous liquid material is provided for preventing, or substantially preventing, such ingress of material from the passage 119. In some embodiments, for example, the total volume of the uphole subspace 130A is at least five (5)% of the total volume of the housing space 130, such as, for example, at least 7.5% of the total volume of the housing space 130, such as, for example, at least ten (10)% of the total volume of the housing space 130. In some embodiments, for example, the total volume of the downhole subspace 130B is at least 50% of the total volume of the housing space 130, such as, for example, at least 75% of the total volume of the housing space 130, such as, for example, at least 90% of the total volume of the housing space 130. Referring to FIGS. 7A-C, where the viscous liquid material is injectable into the housing space 130 via an injection port 144 that extends into a portion of the housing space 130 that is downhole of the stop shoulder 136 (i.e. the downhole subspace 130B), a housing space passage 130C is defined between the stop shoulder 136 and the flow control member 114, and extends from the first subspace 130A to the second subspaces 130B for effecting flow communication between the first and second subspaces 130A, 130B, and thereby enabling viscous liquid material being injected via the injection port 144 to flow and fill the uphole subspace 130A. The path taken by the injected viscous liquid material, as it flow from the first subspace 130A to the second subspace 130B via the housing space passage 130C, is illustrated by flowpath 130D in FIG. 7C. In some embodiments, for example, the stop shoulder 136 and the flow control member 114 are co-operatively configured such that, while the flow control member 114 is engaged to the stop shoulder 136, the housing space passage 130C effects flow communication between the first and second subspaces 130A, 130B, and, in some of these embodiments, for example, has a minimum cross-sectional area of at least 0.015 square inches, such as, for example, at least 0.045 square inches.

The flow control apparatus 115A also includes a confirmation profile 138. In some embodiments, for example, the confirmation profile 138 is defined within the inner surface 140 of the housing 120.

Figure 5:
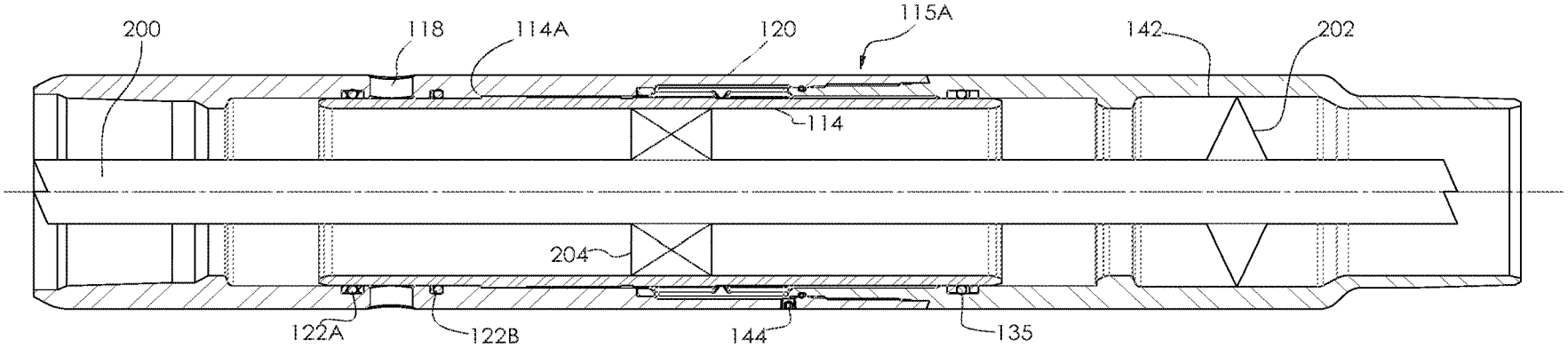
FIG. 5 is a side sectional view of the flow control apparatus of FIGS. 2 to 4, integrated into a wellbore string, with a workstring positioned for displacing the flow control member from a closed position to an open position.
Figure 6:
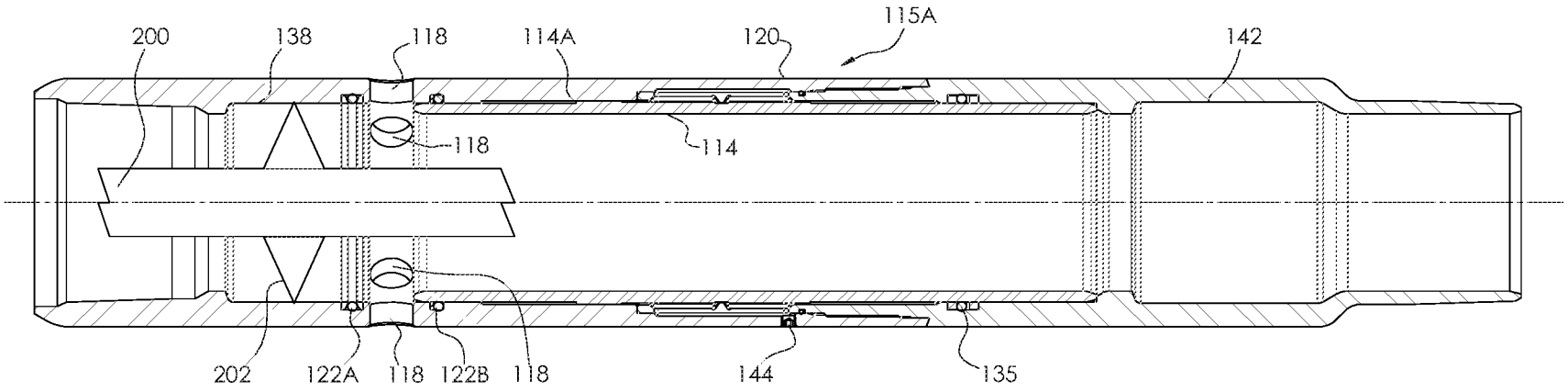
FIG. 6 is a side sectional view of the flow control apparatus of FIGS. 2 to 4, integrated into a wellbore string, with the workstring illustrated in FIG. 5 having becomes positioned for confirming the opening of the port, after the flow control member has been displaced from the closed position to the open position.

Referring to FIGS. 5 and 6, the confirmation profile 138 is establishable, in response to completion of a wellbore operation, for releasably retaining an indicator tool 202 that is being displaced relative to the wellbore 102 via a workstring 200 after the completion of a wellbore operation. Suitable workstrings 200 include coiled tubing, wireline and slickline. In some embodiments, for example, the wellbore operation is one which has effected displacement of a movable member, of the flow control apparatus 115A, relative to the confirmation profile 138. In some embodiments, for example, the releasable retaining of the indicator tool 202, for which the confirmation profile 138 is establishable, is effectible when the indicator tool 202 becomes aligned with the confirmation profile 138.

In some embodiments, for example, after the wellbore operation, upon the indicator tool 202 becoming releasably retained within the confirmation profile 138, resistance is sensed in response to upward pulling on the workstring 200. In this respect, the releasable retaining of the indicator tool 202 by the confirmation profile 138 is confirmed when resistance is sensed in response to upward pulling on the workstring 200. Also in this respect, the releasable retention is such that opposition to relative displacement between the indicator tool 202 and the confirmation profile 138, along the axis of the wellbore 102, is effected.

In some embodiments, for example, prior to completion of the wellbore operation, communication between the indicator tool 202 and the confirmation profile 138 is blocked, such that releasable retention of the indicator tool 202 by the confirmation profile 138 (such as, for example, upon alignment of the indicator tool 202 with the confirmation profile 138) is prevented. In some of these embodiments, for example, the blocking is effected by disposition of the moveable member between the confirmation profile 138 and the indicator tool 202, such that while the indicator tool 202 is aligned with the confirmation profile 138 (such as, for example, while the indicator tool 202 is being running in hole with the workstring 200), the indicator tool 202 is prevented from becoming releasably retained by the confirmation profile 138. In some embodiments, for example, the moveable member is the flow control member 114. In this respect, the wellbore operation includes displacement of the flow control member from the closed position to the open position, and the displacement is with additional effect that interference to the releasable retention of the indicator tool 202 by the confirmation profile 138 has been defeated, such that there is an absence to interference to the releasable retention of the indicator tool 202 by the confirmation profile 138. While the flow control member 114 is disposed in the closed position, communication between the indicator tool 202 and the confirmation profile 138 is blocked, such that releasable retention of the indicator tool 202 by the confirmation profile 138 (such as, for example, upon alignment of the indicator tool 202 with the confirmation profile 138 as the workstring 200 is being run in hole) is prevented by the flow control member 114. While the flow control member 114 is disposed in the open position, the indicator tool 202 is receivable by the confirmation profile 138. In this respect, in some embodiments, for example, the establishing of the confirmation profile 138 includes defeating the interference to the releasable retention of the indicator tool 202 by the confirmation profile 138. Also, in this respect, in some embodiments, for example, the establishing of the confirmation profile 138 includes uncovering of the confirmation profile 138.

In some embodiments, for example, the confirmation profile 138 is recessed into the internal surface 140 of the housing 120, and the indicator tool 202 is biased outwardly relative to the workstring 200, and upon alignment of the indicator tool 202 with the confirmation profile 138 while the flow control member 114 is disposed in the open position, the outward biasing is such that the indicator tool 202 becomes disposed within the confirmation profile 138 such that the indicator tool 202 becomes releasably retained by the confirmation profile 138. In this respect, the defeating of the blocking to the releasable retention of the indicator tool 202 by the confirmation profile 138 includes defeating of the interference to a displacement of the indicator tool 202, owing to the outward biasing of the indicator tool 200, such displacement resulting in the indicator tool 202 becoming disposed within the confirmation profile 138 such that the indicator tool 202 becomes releasably retained by the confirmation profile 138.

In some embodiments, for example, the indicator tool 202 includes a collet, and the collet includes an engagement feature for becoming releasably retained by the confirmation profile 138.

In some embodiments, for example, the collet includes one or more collet springs (such as beam springs) that are separated by slots. In some contexts, the collet springs may be referred to as collet fingers. In some embodiments, for example, the engagement feature is disposed on one or more of the collet springs. In some embodiments, for example, the engagement feature is defined as a protuberance on the collet spring.

In some embodiments, for example, the collet springs are configured for a limited amount of radial compression in response to a radially compressive force. In some embodiments, for example, the collet springs are configured for a limited amount of radial expansion in response to a radially expansive force. Such compression and expansion enable the collet springs to pass by a restriction in the wellbore 102 while returning to its original shape.

In this respect, in some embodiments, for example, the collet includes a resilient member (such as one or more collet springs) that exerts a biasing force for biasing the engagement feature outwardly relative to the workstring 200 such that, while the engagement feature is disposed in alignment with the confirmation profile 138, the biasing force is urging the engagement feature into the releasable retention by the confirmation profile 138.

In some embodiments, for example, the indicator tool 202 is also provided for effecting desired positioning of the workstring 200 relative to the flow control member 114. A shifting tool 204, also coupled to the workstring 200, is positionable, relative to the flow control member 114, to a position such that, upon actuation, the shifting tool 204 becomes disposed in gripping engagement with the flow control member and, in response to application of an opening force while the shifting tool 204 is disposed in gripping engagement with the flow control member 114, effects opening of the port 118 of the flow control apparatus 115A by effecting displacement of the flow control member 114 from the closed position to the open position.

In this respect, the flow control apparatus 115A further includes a locate profile 142, and the locate profile 142 is recessed into the internal surface 140 of the housing 120, and the outward biasing of the indicator tool 202 is such that, upon alignment with the locate profile 142, the indicator tool 202 becomes disposed within the locate profile 142 such that the indicator tool 202 becomes releasably retained by the locate profile 142, and the shifting tool 204 is co-operatively positioned relative to the indicator tool 202 (for example, the shifting tool is disposed in alignment with the flow control member 114) for becoming disposed in gripping engagement with the flow control member 114.

Referring to FIGS. 2 and 3, and to FIGS. 7A and 8A, in some embodiments, for example, the width "W1" of the confirmation profile 138 is the same, or substantially same as the width "W2" of the locate profile 142.

In some embodiments, for example, while the flow control member 114 is disposed in the open position, and it is desired to re-close the one or more ports 118 with the flow control member with the shifting tool 204, it is desirable to avoid releasable retention of the indicator tool 202 within the locate profile 142 as the workstring 200 is manipulated to engage the shifting tool 204 to the flow control member 114 with a view to displacing the flow control member 114, relative to the one or more ports 118, with the shifting tool 204. Otherwise, additional force must be applied to the workstring, to overcome the releasable retention of the indicator tool 202 within the locate profile 142, prior to effecting the displacement of the flow control member 114 relative to the one or more ports 118. In this respect, referring to FIGS. 7A-C and 8A-B, in some embodiments, for example, the flow control member 114 and the locate profile 142 are co-operatively configured such that, while the flow control member 114 is disposed in the open position, the flow control member 114 blocks the indicator tool 202 from becoming releasably retained by the locate profile 142. In some embodiments, for example, the blocking is effected by disposition of the flow control member 114 between the locate profile 142 and the indicator tool 202 while the indicator tool 202 is aligned with the locate profile 142. Relatedly, the flow control member 114 and the locate profile 142 are co-operatively configured such that, while the flow control member 114 is disposed in the closed position, the interference, or blocking, of the releasable retention of the indicator tool 202, is absent. In this respect, the displacement of the flow control member 114, relative to the one or more ports 118, from the closed position to the open position effects the blocking of the locate profile 142, and a displacement of the flow control member 114, relative to the one or more ports 118, from the open position to the closed position effects defeating of the blocking to releasable retention of the indicator tool 202 by the locate profile 142. In those embodiments where the indicator tool 202 is outwardly biased relative to the workstring 202, in some of these embodiments, after the blocking to releasable retention of the indicator tool 202 by the locate profile 142 has been defeated, and while the indicator tool 202 is aligned with the locate profile, the indicator tool 202 becomes releasably retained by the locate profile 142 owing to such outward biasing.

In some embodiments, for example, the indicator tool 202 is any one of the embodiments of the locator tools described in International Application No. PCT/CA2016/000278, which document corresponds to US Published Application No. 2017/0183929 which is hereby incorporated by reference.

Referring to FIGS. 8A and 8B, in some embodiments, for example, a reinforced portion 114X of the flow control member 114 is reinforced by a reinforcing member 114Y. In some embodiments, for example, the reinforcing member 114Y is laminated (such as, for example, by press-fitting) to a laminatable surface portion 114Z of the flow control member 114. In some embodiments, for example, the laminatable surface portion 114Z is disposed on an opposite side of the flow control member 114 relative to the reinforced portion 114X. In some embodiments, for example, when the flow control member 114 is in the form of a sleeve (such as a cylindrical sleeve), the reinforcing member is provided for supplementing the hoop stress of the reinforced portion 114X of the flow control member 114. In some embodiments, for example, the reinforcing member 114Y is a garter ring. The reinforced portion 114X is configured for receiving gripping engagement of the shifting tool 204. The reinforcement effected by the reinforcing member 114Y mitigates deformation of the flow control member 114 in response to gripping engagement of the shifting tool 204. In this respect, the flow control member 114 can be made thinner, thereby easing space restrictions.

In some embodiments, for example, the indicator tool 202 and the shifting tool 204 are co-operatively configured such that, while the indicator tool 202 is being releasably retained by the locate profile 142, the shifting tool 204 is positioned for becoming disposed in gripping engagement with the reinforced portion 114X.

In some embodiments, for example, while the workstring 200 is being displaced through and relative to the wellbore 102, once the indicator tool 202 has become aligned with the locator profile 142, and, in response to the alignment (such as, for example, due to a biasing force), becomes releasably retained within the locate profile 142 (see FIG. 5), resistance is sensed in response to upward pulling on the workstring 200. In this respect, the releasable retaining of the indicator tool 202 by the locate profile 142 is confirmed (i.e. the workstring 200 has been "located") when resistance is sensed in response to upward pulling on the workstring 200. Also in this respect, the releasable retention is such that opposition to relative displacement between the indicator tool 202 and the locate profile 142, along the axis of the wellbore 102, is effected.

After the locating of the workstring 200, and after the displacement of the flow control member from the closed position to the open position, and after the shifting tool 204 becomes retracted relative to the flow control member 114, the workstring 200 is pulled uphole such that the indicator tool 202 is urged to retract from the locate profile 142. In this respect, co-operatively, the locate profile 142 is shaped (for example, tapered inwardly towards the central longitudinal axis of the wellbore, such as, for example, at its uphole end) so as to encourage the retraction of the indicator tool 202 from the locate profile 142 in response to an uphole pulling force. Continued pulling up on the workstring 200 effects uphole displacement of the indicator tool 202 such that the indicator tool 202 becomes aligned with the confirmation profile 138, with effect that the indicator tool 202 becomes outwardly displaced relative to the workstring 200, owing to the outward bias of the indicator tool 202, such that the indicator tool 202 becomes releasably retained by the confirmation profile 138 (see FIG. 6). Upon the sensing of resistance, provided by the releasable retaining of the indicator tool 202 by the confirmation profile 138, in response to upward pulling on the workstring 200, confirmation is provided that the indicator tool 202 has become releasably retained by the confirmation profile 138, and that the flow control member 114 has become disposed in the open position. After this confirmation, treatment material is supplied via the opened one or more ports 118 for effecting stimulation of a hydrocarbon material-containing reservoir within the subterranean formation.

In some embodiments, for example, the indicator tool 202 is configured such that inadvertent disposition of the indicator tool 202 within a recess of the flow control apparatus 115A, other than the confirmation profile 138, is avoided. In this respect, the housing 120, flow control member 114 and the indicator tool 202 are co-operatively configured such that, while the flow control member 114 is disposed in the open position, displacement of the indicator tool 202 (such as, for example, in the uphole direction) from the locate profile 142 to the confirmation profile 138 is sufficiently unimpeded such that there is an absence of sensing of resistance to the displacement. In some embodiments, for example, the co-operative configuration is such that there is an absence of a recess sufficiently sized and is available for receiving displacement of the indicator tool 202 in response to the outward biasing of the indicator tool 202 relative to the workstring 200.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A flow control apparatus comprising:

a confirmation profile that is establishable, in response to completion of a wellbore operation that has changed a condition of the flow control apparatus;

wherein:

the confirmation profile is configured to receive and releasably retain an indicator tool that is being displaced within the wellbore via a workstring;

the change in condition of the flow control apparatus includes a displacement of a moveable member; and the establishment of the confirmation profile is effected by the displacement of the moveable member, relative to the confirmation profile, between hard stops that define a range of travel of the moveable member, wherein the confirmation profile is established outside the range of travel defined by the hard stops.

2. The flow control apparatus as claimed in claim 1, further comprising:

a housing including an internal surface;

wherein:

the confirmation profile is recessed into the internal surface of the housing.

3. The flow control apparatus as claimed in claim 1; wherein:

the confirmation profile is configured such that, while the indicator tool is releasably retained within the confirmation profile, opposition to relative displacement between the indicator tool and the confirmation profile, along the axis of the wellbore, is effected by interference between the indicator tool and the confirmation profile.

4. The flow control apparatus as claimed in claim 1, wherein:

the movable member and the confirmation profile are co-operatively configured such that the displacement of the movable member relative to the confirmation profile effects uncovering of the confirmation profile such that the confirmation profile is established.

5. The flow control apparatus as claimed in claim 4;

wherein the movable member includes a flow control member, and the displacement of the movable member, for effecting establishment of the confirmation profile, includes displacement of the flow control member to an open position.

6. The flow control apparatus as claimed in claim 5, further comprising:

a locate profile configured to receive and releasably retain the indicator tool;

wherein:

the movable member, the locate profile and the confirmation profile are co-operatively configured such that the locate profile remains disposed for receiving and releasably retaining the indicator tool upon displacement of the movable member relative to the confirmation profile.

7. The flow control apparatus as claimed in claim 1;

wherein the established confirmation profile is disposed such that the releasable retaining of the indicator tool is effectible when the indicator tool becomes aligned with the confirmation profile.

8. The flow control apparatus as claimed in claim 7, further comprising:

a locate profile for releasably retaining the indicator tool.

9. The flow control apparatus as claimed in claim 8;

wherein the width of the confirmation profile is the same, or substantially same as the width of the locate profile.

10. The flow control apparatus as claimed in claim 8;

wherein the locate profile is disposed such that the releasable retaining of the indicator tool is effectible when the indicator tool becomes aligned with the locate profile.

11. The flow control apparatus as claimed in claim 10;

wherein:

the locate profile, the confirmation profile and the moveable member are cooperatively configured such that, while the confirmation profile is established, the locate profile is configured for receiving and releasable retaining the indicator tool.

12. The flow control apparatus as claimed in claim 1;

wherein the flow control apparatus is configured for coupling to a casing string.

13. The flow control apparatus as claimed in claim 12;

wherein the coupling is a threaded coupling.

14. A system comprising:

an indicator tool that is deployable into a wellbore via a workstring; and a downhole flow control apparatus including a confirmation profile that is establishable, in response to completion of a wellbore operation that has changed a condition of the flow control apparatus;

wherein:

the conformation profile is configured to receive and releasably retain the indicator tool that is being displaced relative to the wellbore via the workstring;

the change in condition of the flow control apparatus includes a displacement of a moveable member; and the establishment of the confirmation profile is effected by the displacement of the moveable member, relative to the confirmation profile, between hard stops that define a range of travel of the moveable member, the confirmation profile being established outside the range of travel defined by the hard stops.

15. The system as claimed in claim 14;

wherein:

the movable member and the confirmation profile are co-operatively configured such that the displacement of the movable member relative to the confirmation profile effects uncovering of the confirmation profile such that the confirmation profile is established.

16. The system as claimed in claim 15;

wherein the movable member includes a flow control member, and the displacement of the movable member, for effecting establishment of the confirmation profile, includes displacement of the flow control member to an open position.

17. The system as claimed in claim 14;

wherein the releasable retaining of the indicator tool, for which the confirmation profile is establishable, is effectible when the indicator tool becomes aligned with the confirmation profile.

18. The system as claimed in claim 14;

wherein the downhole flow control apparatus includes a locate profile for releasably retaining the indicator tool.

19. The system as claimed in claim 18;

wherein the locate profile is disposed such that the releasable retaining of the indicator tool is effectible when the indicator tool becomes aligned with the locate profile.

20. A downhole process comprising:

within a wellbore, performing a downhole wellbore operation with effect that a confirmation profile is established upon completion of the downhole wellbore operation, wherein:

the confirmation profile is configured to receive and releasably retain an indicator tool that is being displaced within the wellbore via a workstring;

the change in condition of the flow control apparatus includes a displacement of a flow control member; and the establishment of the confirmation profile is effected by the displacement of the flow control member, relative to the confirmation profile, between hard stops that define a range of travel of the flow control member, the confirmation profile being established outside the range of travel defined by the hard stops;

confirming the completion of the downhole wellbore operation by locating the indicator tool within the confirmation profile and detecting the locating of the indicator tool within the confirmation profile by detecting resistance to uphole displacement of the indicator tool relative to the wellbore.

21. The downhole process as claimed in claim 20;

wherein the downhole wellbore operation effects displacement of the flow control member with effect that: (i) the confirmation profile is established, and (ii) fluid communication is effected between the wellbore and a subterranean formation.

22. The downhole process as claimed in claim 21;

wherein the displacement of the flow control member effects uncovering of the confirmation profile.

23. The downhole process as claimed in claim 20;

wherein:

the confirmation profile is defined within an internal surface of a wellbore string; and the confirming is effected in response to alignment of the indicator tool with the confirmation profile.

* * * * *